US007734229B2

(12) United States Patent
Tanaka et al.

(10) Patent No.: US 7,734,229 B2
(45) Date of Patent: Jun. 8, 2010

(54) TONER REPLENISHING METHOD, TONER REPLENISHING APPARATUS, AND COMPUTER READABLE RECORDING MEDIUM

(75) Inventors: Tatsuya Tanaka, Yamatokoriyama (JP); Kyosuke Taka, Nara (JP); Takashi Kitagawa, Yamatokoriyama (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 163 days.

(21) Appl. No.: 11/879,925

(22) Filed: Jul. 19, 2007

(65) Prior Publication Data

US 2008/0019712 A1 Jan. 24, 2008

(30) Foreign Application Priority Data

Jul. 19, 2006 (JP) ..... 2006-197502

(51) Int. Cl.
*G03G 15/08* (2006.01)

(52) U.S. Cl. ..... 399/255; 399/30; 399/59; 399/62

(58) Field of Classification Search ..... 399/30, 399/59, 62, 255
See application file for complete search history.

(56) References Cited

U.S. PATENT DOCUMENTS

| | | | | |
|---|---|---|---|---|
| 5,122,834 | A * | 6/1992 | Okamoto et al. | 399/63 |
| 5,581,326 | A * | 12/1996 | Ogata et al. | 399/30 |
| 6,404,997 | B1 * | 6/2002 | Grace | 399/27 |
| 2006/0127108 | A1 | 6/2006 | Okuyama et al. | |
| 2006/0127109 | A1 | 6/2006 | Itoyama | |

FOREIGN PATENT DOCUMENTS

| | | | |
|---|---|---|---|
| CN | 1786844 | A | 6/2006 |
| CN | 1790182 | A | 6/2006 |
| JP | 04-304486 | | 10/1992 |
| JP | 05-088554 | | 4/1993 |
| JP | 08-110699 | | 4/1996 |
| JP | 08202137 | A * | 8/1996 |
| JP | 2002-333774 | | 11/2002 |
| JP | 2005-092151 | | 4/2005 |
| JP | 2005-099142 | | 4/2005 |
| JP | 2006-308941 | A * | 4/2005 |
| JP | 2005-292237 | | 10/2005 |
| JP | 2006-091211 | | 4/2006 |

OTHER PUBLICATIONS

Machine Translation of JP 2006-308941 A, Apr. 2005, Japan.*

* cited by examiner

*Primary Examiner*—David M Gray
*Assistant Examiner*—Barnabas T Fekete
(74) *Attorney, Agent, or Firm*—Edwards Angell Palmer & Dodge LLP; David G. Conlin; David A. Tucker

(57) ABSTRACT

A pixel count section calculates a coverage rate corresponding to toner consumption. A control coefficient value setting section determines, based on the coverage rate, a stop threshold value representing reference concentration for toner replenishment and replenishment extension time. A magnetic permeability sensor measures permeability representing toner concentration in a housing portion. A toner concentration control section starts toner replenishment when an output value from the magnetic permeability sensor varies from a value less than a start threshold value to the start threshold value or above, and stops toner replenishment after lapse of replenishment extension time from the time at which an output value varied from a value greater than the stop threshold value to the stop threshold value.

13 Claims, 10 Drawing Sheets

TONER REPLENISHING METHOD, TONER REPLENISHING APPARATUS, AND COMPUTER READABLE RECORDING MEDIUM

CROSS-REFERENCE TO RELATED APPLICATION

This application claims priority to Japanese Patent Application No. 2006-197502, which was filed on Jul. 19, 2006, the contents of which are incorporated herein by reference in its entirety.

BACKGROUND OF THE INVENTION

1. Field of the Invention

The present invention relates to a method of replenishing toner for a housing portion for accommodating therein a dual-component developer composed of toner and carrier, a toner replenishing apparatus, and a computer readable recording medium having a program stored thereon which allows a computer to effect a toner replenishing function.

2. Description of the Related Art

In a development process based on electrophotography, an image is formed by causing toner to be electrostatically adhered to an electrostatic latent image formed on a photoreceptor drum.

FIG. 9 is a view schematically showing a housing portion 1 for accommodating therein a dual-component developer composed of toner and carrier. As the toner is consumed in the course of development process, so the concentration of the toner within the housing portion 1 is caused to vary. In a case where the concentration of the toner within the housing portion 1 is deviated from an intended concentration, it becomes impossible to obtain a desired image due to an undesirable increase or decrease in the density of a developed image, scattering of the toner, and so forth. Accordingly, the concentration of the toner within the housing portion 1 needs to be maintained at the intended concentration by effecting replenishment of toner in an appropriate manner.

Toner is supplied through a toner replenishment inlet 2 formed at one end of the housing portion 1. The housing portion 1 includes an agitating roller for agitating and conveying the toner supplied through the toner replenishment inlet 2. The toner fed into the housing portion 1 is circulated inside the housing portion 1 while being agitated with carrier by the agitating roller. In FIG. 9, a direction in which the toner is moved is indicated by arrows 3. Together with the carrier, the toner is adhered once to a magnet roller 4, and subsequently the toner is adhered to that part of a photoreceptor drum which bears an electrostatic latent image, and it is thereupon consumed. The housing portion 1 is provided with an ATC (Auto Toner Control) sensor 5 for detecting toner concentration. With the necessity of detecting the concentration of the toner in the developer under the condition that the toner and the carrier have been agitated together, the ATC sensor 5 is spaced a predetermined distance away from the toner replenishment inlet 2 on a downstream side in a toner conveying direction. Therefore, according to the related art, there is a time delay of about 5 to 6 seconds before the ATC sensor 5 detects variation in toner concentration resulting from the replenishment of toner through the toner replenishment inlet 2. Furthermore, since the toner is consumed at the magnet roller 4, even if replenishment is required following the consumption of the toner, there is a time delay of about 10 to 15 seconds before the necessity of toner replenishment is detected by the ATC sensor 5.

The larger is the amount of toner consumption in a unit of time, the greater is the variation of the concentration of the toner within the housing portion 1 in a unit of time. When the amount of toner consumption is small, the variation of the toner concentration in a unit of time is insignificant correspondingly. In this case, even if the replenishment of toner is effected to adjust the current toner concentration detected by the ATC sensor 5 to a predetermined concentration, it is possible to keep the toner concentration constant. However, when the amount of toner consumption is large, the variation of the toner concentration in a unit of time is significant correspondingly. In this case, in accompaniment with the replenishment of toner for adjusting the current toner concentration detected by the ATC sensor 5 to the predetermined concentration, the toner concentration is deviated considerably from the intended concentration. Therefore, in a case of effecting the replenishment of toner on the basis of the toner concentration detected by the ATC sensor 5, the toner concentration cannot be maintained at the intended concentration, thus causing a ripple in the concentration of the toner adhered to the magnet roller 4. The time period of the ripple corresponds to the time taken for the toner to go around inside the housing portion 1.

FIG. 10 is a graph showing the variation of the value of output from a magnetic permeability sensor with respect to time and the change of the state of a toner motor between an ON state and an OFF state with respect to time, as observed when toner is fed into the housing portion 1 with use of the related art. In the graph, the value of output from the magnetic permeability sensor is taken along the vertical axis, and the time is taken along the horizontal axis.

The ATC sensor 5 is realized by using the magnetic permeability sensor. The value of output from the magnetic permeability sensor represents the concentration of the toner within the housing portion 1. Moreover, the replenishment of toner is effected during the time the toner motor for rotating a toner bottle is kept in an ON state, but it is not effected during the time the toner motor is kept in an OFF state. According to the related art, the switching between the ON and OFF states of the toner motor is made every time the concentration of toner crosses a threshold value. In this way, the replenishment of toner to the housing portion 1 is controlled. A repeat of the switching between the ON and OFF states of the toner motor results in an increasingly significant variation of toner concentration, and also makes it impossible to achieve continuous toner replenishment.

In a toner replenishing apparatus according to one related art, the amount of toner consumption is calculated on the basis of a coverage rate, the number of pages printed, and a predetermined constant of toner consumption. Then, toner is replenished based on the amount of toner consumption obtained by calculation and the concentration of toner. In this way, the replenishment of toner is effected in accordance with the amount of toner consumption thereby to maintain the concentration of toner constant (refer to Japanese Unexamined Patent Publication JP-A 4-304486 (1992)).

In an image forming apparatus according to another related art, the amount of toner to be replenished is conjectured based on the concentration of toner. Moreover, the amount of toner consumption is measured on the basis of the number of pixels of an electrostatic latent image. Then, a conjectured amount of toner is replenished with each toner consumption. In this way, the replenishment of toner is effected in accordance with the amount of toner consumption thereby to maintain the concentration of toner constant (refer to Japanese Unexamined Patent Publication JP-A 5-88554 (1993)).

In an image forming apparatus according to yet another related art, an output signal from a toner concentration sensor is shifted in accordance with a coverage rate. On the basis of the shifted output signal, the replenishment of toner is effected. In this way, the timing of toner replenishment is changed in accordance with a coverage rate thereby to maintain the concentration of toner constant (refer to Japanese Unexamined Patent Publication JP-A 2002-333774).

In each of the related art constructions thus far described, the replenishment of toner is effected in consideration of the amount of toner consumption. However, in a case of performing printing with a high degree of coverage rate, the amount of toner consumption is large, and the range of variation in the concentration of toner is wide correspondingly. This gives rise to a problem of occurrence of a ripple. Furthermore, the switching between the ON and OFF states of the toner motor is repeated in keeping with the ripple, which results in a further widening of the range of variation in the concentration of toner. This makes it impossible to achieve continuous toner replenishment. As still another problem, a toner shortage may be caused due to a failure of replenishing toner in good time.

SUMMARY OF THE INVENTION

An object of the invention to provide a toner replenishing method that succeed in narrowing the range of variation in the concentration of toner, in achieving continuous toner replenishing without repeating ON/OFF switching operations, and in replenishing toner sufficiently without causing a toner shortage even if the amount of toner consumption is large, a toner replenishing apparatus, and a computer readable recording medium.

The invention provides a toner replenishing method comprising:

a concentration measurement step of measuring a concentration of toner in a housing portion in which is accommodated a dual-component developer composed of toner and carrier;

a consumption calculation step of determining an amount of toner consumption;

a setting step of setting, based on the amount of toner consumption determined in the consumption calculation step, a reference concentration for replenishment of toner to the housing portion and replenishment extension time for continuing the replenishment of toner to the housing portion after the concentration of toner reaches the reference concentration; and a toner concentration adjustment step of starting the replenishment of toner to the housing portion when the concentration of toner measured in the concentration measurement step is found to be equal to or less than a predetermined replenishment starting concentration, and stopping the replenishment of toner to the housing portion at a time following a lapse of the replenishment extension time from a time at which the concentration of toner of less than the reference concentration reached the reference concentration.

According to the invention, the concentration of toner in the housing portion is measured in the concentration measurement step, and then the amount of toner consumption is determined in the consumption calculation step. In the setting step, based on the determined amount of toner consumption, the reference concentration for the replenishment of toner to the housing portion and the replenishment extension time for continuing the replenishment of toner to the housing portion after the concentration of toner reaches the reference concentration are determined.

The speed with which the concentration of toner in the housing portion declines is dependent on the amount of toner consumption. That is, the smaller is the amount of toner consumption, the lower is the toner concentration declining speed, and, the larger is the amount of toner consumption, the higher is the toner concentration declining speed. Therefore, in order to keep the concentration of toner in the housing portion constant, there is a need to adjust the amount of toner to be replenished for the housing portion in accordance with the amount of toner consumption.

When the concentration of toner in the housing portion is decreased to the replenishment starting concentration or below, the replenishment of toner to the housing portion is started. Upon starting of the replenishment of toner, the concentration of toner in the housing portion is caused to rise. Even after the concentration of toner exceeds the replenishment starting concentration and eventually reaches the reference concentration, the replenishment of toner is continued until the replenishment extension time has elapsed. In this way, since the replenishment of toner is effected on the basis of the toner replenishment starting concentration, the reference concentration, and the replenishment extension time, it follows that the amount of toner to be replenished is prescribed in accordance with the reference concentration and the replenishment extension time. In a case where a location at which the toner in the housing portion is consumed and a location at which toner concentration measurement is effected are separated from each other, there is a time delay of, for example, about 15 seconds in an actually measured concentration with respect to the concentration corresponding to the location at which the toner is consumed. In this case, as the amount of toner consumption is increased, a ripple is caused in the variation of the concentration of toner. However, so long as a sufficiently large differential is secured between the replenishment starting concentration and the reference concentration and also the replenishment extension time is sufficiently long, then the replenishment of toner can be continued without repeating ON/OFF switching operations. This helps narrow the range of variation in the concentration of toner, namely the range of ripple. In the setting step, based on the amount of toner consumption determined in the consumption calculation step, not only the reference concentration but also the replenishment extension time are determined. In this way, the amount of toner to be replenished that is appropriate to the amount of toner consumption is determined.

In the toner concentration adjustment step, the replenishment of toner is controlled on the basis of the replenishment starting concentration, the reference concentration, and the replenishment extension time which defines the amount of toner to be replenished. Accordingly, toner is replenished in an amount appropriate to the amount of toner actually consumed. In this way, the range of variation in the concentration of toner within the housing portion can be narrowed regardless of the amount of toner consumption.

In the invention, it is preferable that, in the consumption calculation step, in accordance with a tone of each pixel constituting an image to be printed by an image forming apparatus, an amount of toner to be consumed for forming each of the pixels is obtained, and the operation of addition is performed on the amount of toner to be consumed thus obtained.

According to the invention, the amount of toner to be consumed for forming each of the pixels is determined according to the tone of each of the pixels. Then, by performing the operation of addition on the determined amount of toner to be consumed, the amount of toner consumption is derived. Since the amount of toner to be consumed for forming each of the pixels is dependent on its tone, in this case, as compared with the case of calculating the amount of toner consumption in a simple manner with no consideration given to tones, it is possible to obtain the amount of toner consumption more accurately. On the basis of the amount of toner consumption thus obtained with accuracy, the reference concentration and the replenishment extension time are determined. Accordingly, toner can be replenished in response to the amount of toner actually consumed thereby to narrow the range of variation in the concentration of toner within the housing portion.

In the invention, it is preferable that, in the setting step, the reference concentration is so determined as to be equal to or greater than the replenishment starting concentration.

According to the invention, the reference concentration is so determined as to be equal to or greater than the replenishment starting concentration. By determining the reference concentration and the replenishment starting concentration in that way, as has already been described, it is possible to determine the amount of toner to be replenished that is appropriate to the amount of toner consumption.

In the invention, it is preferable that, in the setting step, when the amount of toner consumption determined in the consumption calculation step is less than a predetermined value, the replenishment extension time is set at a value of 0 second, and, when the amount of toner consumption is equal to or greater than the predetermined value, the replenishment extension time is set at a value of greater than 0 second.

According to the invention, the replenishment extension time is set at a value of 0 second when the amount of toner consumption is less than a predetermined value, and is set at a value of greater than 0 second when the amount of toner consumption is equal to or greater than the predetermined value. The longer is the replenishment extension time, the larger is the amount of toner to be replenished. In this way, by determining the replenishment extension time in accordance with the amount of toner consumption, it is possible to replenish toner for the housing portion in response to the amount toner to be consumed.

In the invention, it is preferable that, in the setting step, the reference concentration and the replenishment extension time are determined with reference to a correlation table showing the correlation among the amount of toner consumption, the reference concentration, and the replenishment extension time.

According to the invention, owing to the setting step as mentioned above, the need to calculate the reference concentration and the replenishment extension time on the basis of the amount of toner consumption in a sequential manner is eliminated. Accordingly, the process of determining the reference concentration and the replenishment extension time can be carried out with lesser degree of burdens.

In the invention, it is preferable that the housing portion is provided with an agitating/conveying member for agitating the developer accommodated in the housing portion and allowing the developer to circulate through a circulation path formed within the housing portion, and a concentration measurement section for measuring the concentration of toner in a certain part of the circulation path that is on a downstream side of the toner replenishment position in a toner conveying direction, and at a location on a downstream side of the concentration measurement section in the toner conveying direction, toner is supplied to a photoreceptor member for recording an electrostatic latent image.

According to the invention, the housing portion is provided with an agitating/conveying member for agitating the developer accommodated in the housing portion and allowing the developer to circulate through a circulation path formed within the housing portion, and a concentration measurement section for measuring the concentration of toner in a certain part of the circulation path that is on a downstream side of the toner replenishment position in a toner conveying direction, and at a location on a downstream side of the concentration measurement section in the toner conveying direction, toner is supplied to a photoreceptor member for recording an electrostatic latent image. In this case, since the toner concentration measuring location is placed differently from the location of toner replenishment and from the location of toner consumption near the photoreceptor member, it is impossible to replenish toner in reality based on the concentration corresponding to the location of toner replenishment and the concentration corresponding to the vicinity of the photoreceptor member. However, as has already been described, when the toner replenishment method according to the invention is employed, by determining the reference concentration and the replenishment extension time on the basis of the amount of toner consumption, it is possible to replenish toner in an amount appropriate to the amount of toner actually consumed. This makes it possible to narrow the range of variation in the concentration of toner within the housing portion.

In the invention, it is preferable that, in the setting step, the replenishment extension time is so determined as to fulfill the following formula (1):

$$0 \leqq A \leqq 3 \cdot T/4 \quad (1)$$

wherein A is the replenishment extension time and T is one cycle of time-periodical variation in the concentration of toner measured by the concentration measurement section.

According to the invention, with respect to one cycle T of the time-periodical variation of the concentration of toner, the replenishment extension time A is so selected as to fulfill the formula: $0 \leqq A \leqq 3 \cdot T/4$. Even if control is exercised in a manner so as to insure that the concentration of toner is kept constant for the housing portion designed to allow circulation of toner, the concentration of toner is varied periodically, thus causing a ripple. In this regard, the replenishment extension time A is so determined as to fulfill the formula: $0 \leqq A \leqq 3 \cdot T/4$ with respect to the periodic time variation T of the concentration of toner. Then, as has already been described, the replenishment of toner to the housing portion is effected on the basis of the replenishment extension time A, the replenishment starting concentration, and the reference concentration. In this case, the range of periodic variation in the concentration of toner can be narrowed.

In the invention, it is preferable that, in the setting step, when the amount of toner consumption is equal to or greater than a predetermined value, the replenishment extension time is so determined as to fulfill the following formula (2):

$$T/4 \leqq A \leqq T/2 \quad (2)$$

wherein A is the replenishment extension time and T is one cycle of time-periodical variation in the concentration of toner measured by the concentration measurement section.

According to the invention, when the amount of toner consumption is equal to or greater than the predetermined value, the replenishment extension time A is so determined as to fulfill the formula: $T/4 \leqq A \leqq T/2$. In this way, the setting of the replenishment extension time A is achieved. Then, as has already been described, the replenishment of toner to the housing portion is effected on the basis of the replenishment extension time A, the replenishment starting concentration, and the reference concentration. In this case, the range of periodic variation in the concentration of toner can be narrowed.

In the invention, it is preferable that, in the setting step, when the amount of toner consumption is equal to or greater than a predetermined value, the replenishment extension time is so determined as to fulfill the following formula (3):

$$A=3\cdot T/8 \quad (3)$$

wherein A is the replenishment extension time and T is one cycle of time-periodical variation in the concentration of toner measured by the concentration measurement section.

According to the invention, when the amount of toner consumption is equal to or greater than the predetermined value, the replenishment extension time A is so determined as to fulfill the formula: A=3·T/8. In this way, the setting of the replenishment extension time A is achieved. Then, as has already been described, the replenishment of toner to the housing portion is effected on the basis of the replenishment extension time A, the replenishment starting concentration, and the reference concentration. In this case, the range of periodic variation in the concentration of toner can be narrowed.

In the invention, it is preferable that, in the setting step, the replenishment extension time is so determined as to fulfill the following formula (4):

$$0\leqq A\leqq 3\cdot U/4 \quad (4)$$

wherein A is the replenishment extension time and U is the time taken for toner to make a one round through the circulation path in the housing portion.

According to the invention, with respect to the time U taken for toner to make a one round through the circulation path, the replenishment extension time A is so selected as to fulfill the formula: 0≦A≦3·U/4. Under the condition that the replenishment extension time A is so determined as to fulfill the formula: 0≦A≦3·U/4, as has already been described, the replenishment of toner to the housing portion is effected on the basis of the replenishment extension time A, the replenishment starting concentration, and the reference concentration. In this case, the range of periodic variation in the concentration of toner can be narrowed.

The invention provides a toner replenishing apparatus comprising:

a concentration measurement section for measuring a concentration of toner in a housing portion in which is accommodated a dual-component developer composed of toner and carrier;

a consumption calculation section for determining an amount of toner consumption;

a setting section for setting, based on the amount of toner consumption determined in the consumption calculation section, a reference concentration for a replenishment of toner to the housing portion and replenishment extension time for continuing the replenishment of toner to the housing portion after the concentration of toner reaches the reference concentration; and a toner concentration adjustment section for staring the replenishment of toner to the housing portion when the concentration of toner measured in the concentration measurement section is found to be equal to or less than a predetermined replenishment starting concentration, and stopping the replenishment of toner to the housing portion at a time following a lapse of the replenishment extension time from a time at which the concentration of toner of less than the reference concentration reached the reference concentration.

According to the invention, the concentration of toner in the housing portion is measured in the concentration measurement section, and then the amount of toner consumption is determined in the consumption calculation section. In the setting section, based on the determined amount of toner consumption, the reference concentration for the replenishment of toner to the housing portion and the replenishment extension time for continuing the replenishment of toner to the housing portion after the concentration of toner reaches the reference concentration are determined. As has already been described, since the amount of toner to be replenished is prescribed in accordance with the replenishment starting concentration, the reference concentration, and the replenishment extension time, it follows that the setting section determines the amount of toner to be replenished that is appropriate to the amount of toner consumption.

In the toner concentration adjustment section, the replenishment of toner is controlled on the basis of the replenishment starting concentration, the reference concentration, and the replenishment extension time for defining the amount of toner to be replenished. Accordingly, toner is replenished in an amount appropriate to the amount of toner actually consumed. In this way, the range of variation in the concentration of toner within the housing portion can be narrowed regardless of the amount of toner consumption.

In the invention, it is preferable that the housing portion houses an agitating/conveying member for agitating the developer and allowing the developer to circulate through a circulation path formed within the housing portion, and the concentration measurement section is disposed in a certain part of the circulation path that is on a downstream side of the toner replenishment position in a toner conveying direction, and at a location on a downstream side of the concentration measurement section in the toner conveying direction, toner is supplied to a photoreceptor member for recording an electrostatic latent image.

According to the invention, the housing portion houses an agitating/conveying member for agitating the developer and allowing the developer to circulate through a circulation path formed within the housing portion, and the concentration measurement section is disposed in a certain part of the circulation path that is on a downstream side of the toner replenishment position in a toner conveying direction, and at a location on a downstream side of the concentration measurement section in the toner conveying direction, toner is supplied to a photoreceptor member for recording an electrostatic latent image. In this case, since the toner concentration measurement location is placed differently from the location of toner replenishment and from the location of toner consumption near the photoreceptor member, it is impossible to replenish toner in reality based on the concentration corresponding to the location of toner replenishment and the concentration corresponding to the vicinity of the photoreceptor member. However, as has already been described, when the toner replenishment method according to the invention is employed, by determining the reference concentration and the replenishment extension time on the basis of the amount of toner consumption, it is possible to replenish toner in an amount appropriate to the amount of toner actually consumed. This makes it possible to narrow the range of variation in the concentration of toner within the housing portion.

The invention provides a computer readable recording medium having a program stored thereon which allows a computer to effect:

a consumption calculation function for determining an amount of toner consumption;

a setting function for setting, based on the amount of toner consumption obtained, a reference concentration for a replenishment of toner to a housing portion in which is accommodated a dual-component developer composed of toner and carrier, and replenishment extension time for continuing the replenishment of toner to the housing portion after the concentration of toner reaches the reference concentration; and a toner concentration adjustment function for starting the replenishment of toner to the housing portion when the concentration of toner in the housing portion is found to be equal to or less than a replenishment starting concentration, and stopping the replenishment of toner to the housing portion at a time following a lapse of the replenishment extension time from a time at which the concentration of toner of less than the reference concentration reached the reference concentration.

According to the invention, with the execution of the program by the computer, the toner replenishing apparatus can be subjected to control in accordance with the toner replenishing method thus far described. Thereby, as has already been described, the range of variation in the concentration of toner within the housing portion can be narrowed successfully.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
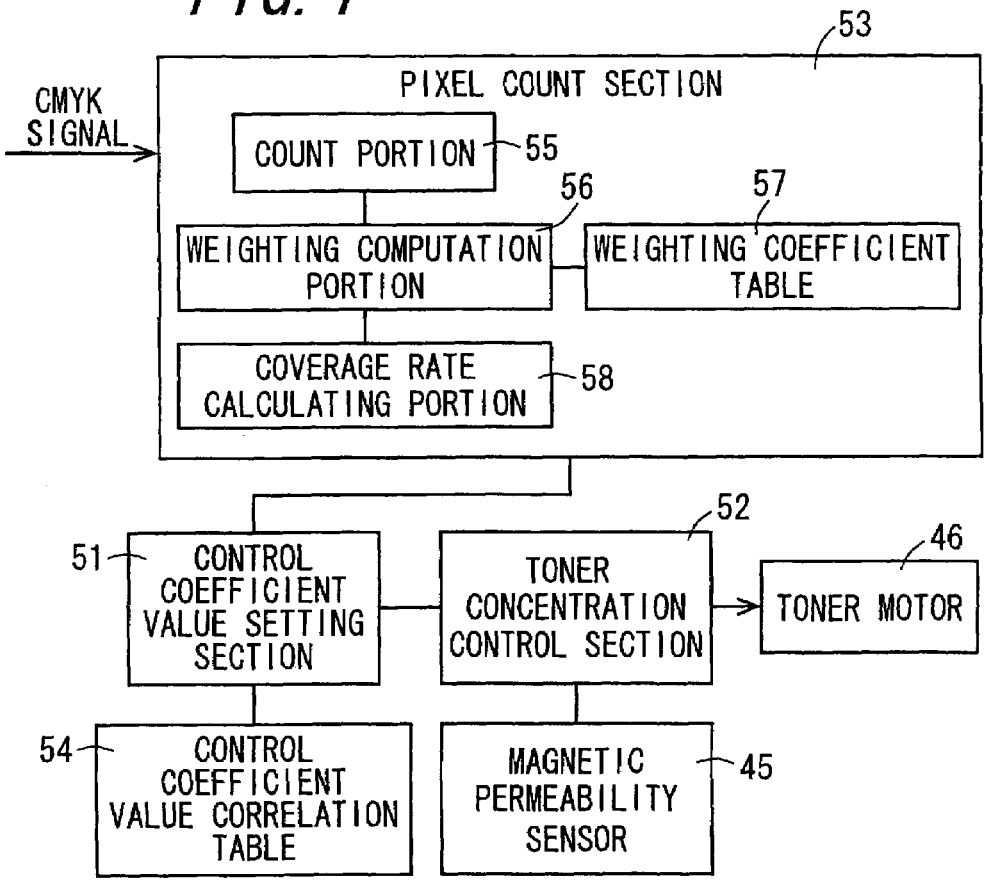
FIG. 1 is a block diagram showing the structure of a toner replenishing apparatus in accordance with one embodiment of the invention.

Now referring to the drawings, preferred embodiments of the invention are described below.

Figure 2:
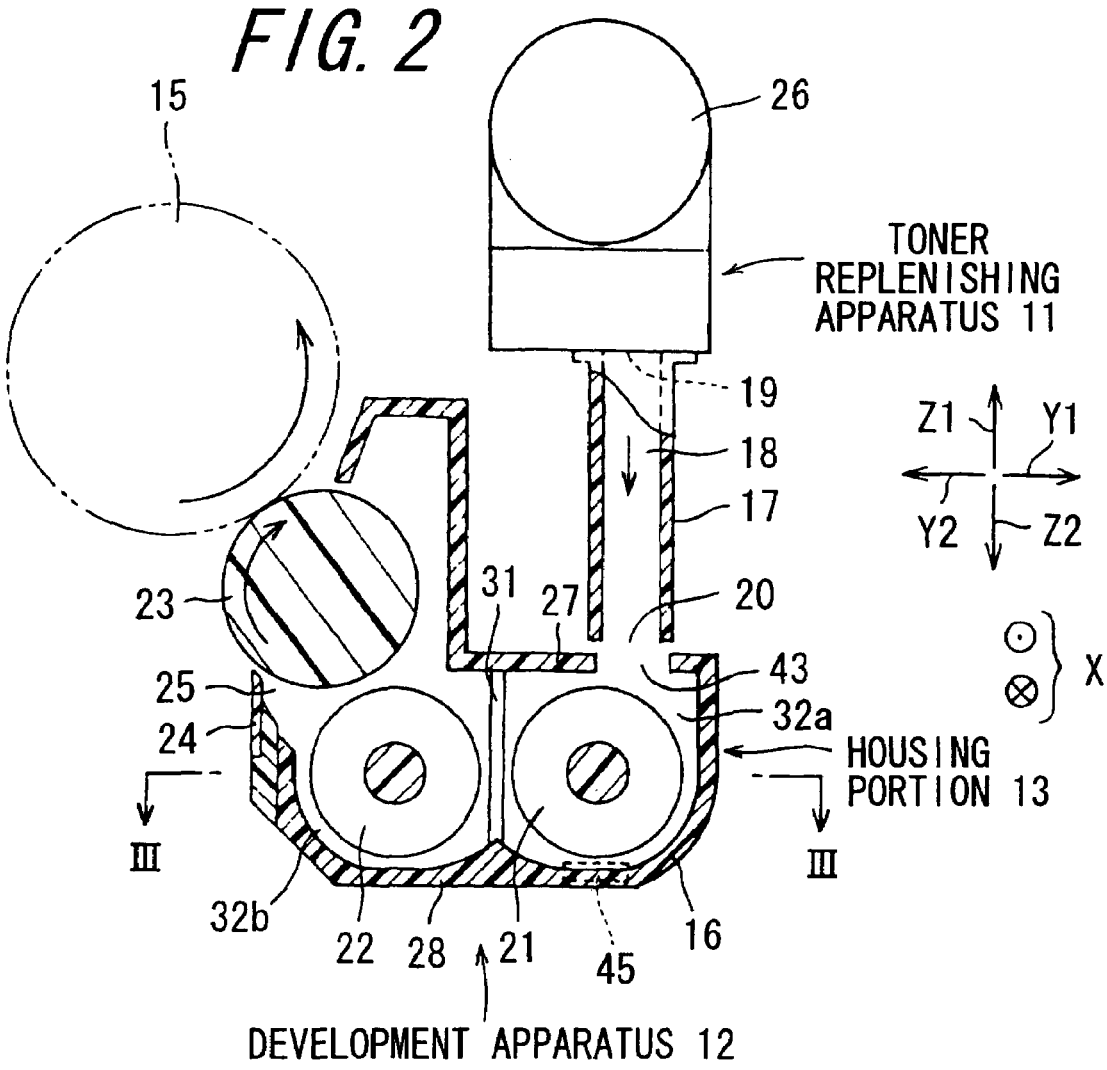
FIG. 2 is a sectional view showing the toner replenishing apparatus and a development apparatus.
Figure 3:
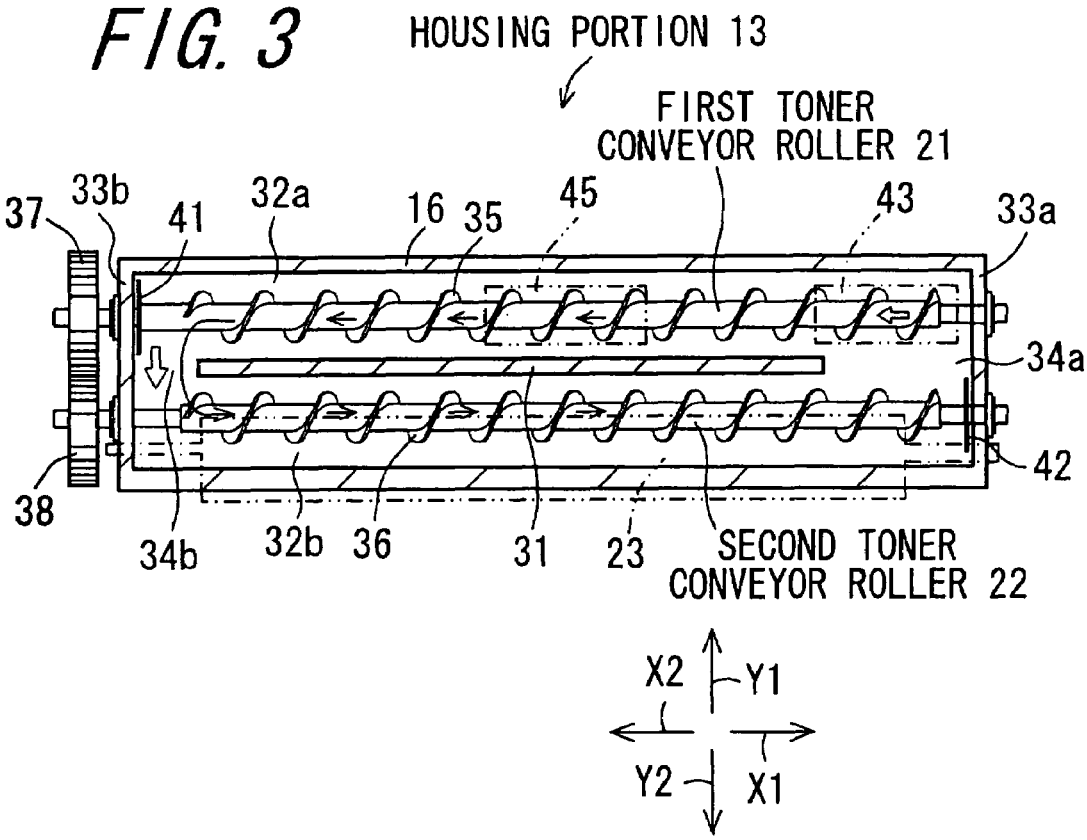
FIG. 3 is a sectional view showing a housing portion taken along the line III-III of FIG. 2.

FIG. 1 is a block diagram showing the structure of a toner replenishing apparatus 11 in accordance with one embodiment of the invention. FIG. 2 is a sectional view showing the toner replenishing apparatus 11 and a development apparatus 12. FIG. 3 is a sectional view showing a housing portion 13 taken along the line III-III of FIG. 2.

The toner replenishing apparatus 11 and the development apparatus 12 are incorporated in an image forming apparatus 14 which will hereinafter be described. The toner replenishing apparatus 11 acts to replenish toner to the development apparatus 12. The development apparatus 12 acts to provide the toner supplied from the toner replenishing apparatus 11 to a surface of a photoreceptor drum 15 which corresponds to a photoreceptor member which will hereinafter be described.

The development apparatus 12 includes the housing portion 13 for accommodating a dual-component developer composed of toner and carrier, and a toner introducing pipe 17. The toner introducing pipe 17 is formed in the shape of a tube which extends in a vertical direction Z under the condition that the image forming apparatus 14 is placed in an operating state. Hereafter, an explanation as to the construction will be given under the assumption that the image forming apparatus 14 is placed in an operating state. The toner replenishing apparatus 11 is designed to feed toner into the toner introducing pipe 17 through an opening 19 formed in an upper part of the toner introducing pipe 17, which is located on an upper side Z1 with respect to the vertical direction Z. The toner that has been fed into the toner introducing pipe 17 passes through a pipe path 18, and is then introduced into the housing portion 13 through an opening 20 formed in a lower part of the toner introducing pipe 17, which is located on a lower side Z2 with respect to the vertical direction Z.

The housing portion 13 is so constructed as to include an enclosure 16, the outside shape of which extends in a first direction X which is perpendicular to the vertical direction Z, and, a first toner convey or roller 21, a second toner conveyor roller 22, a magnet roller 23, and a blade 24 that are arranged in the enclosure 16. Hereafter, a direction which is perpendicular to the vertical direction Z and the first direction X is defined as a second direction Y.

At the end portion of the enclosure 16, which is located on the other side Y2 with respect to the second direction Y, is formed an opening 25 so as to extend across both ends of the enclosure 16 in the first direction X. The magnet roller 23 is rotatably supported by the enclosure 16, with its axis of rotation arranged in parallel with the first direction X. Part of the outer circumferential region of the magnet roller 23 is exposed at the opening 25. The magnet roller 23 is disposed face to face with the photoreceptor drum 15 in abutment or proximate relation to the photoreceptor drum 15.

The enclosure 16 provides a housing space for accommodating a developer. The enclosure 16 includes a partition plate 31 for partitioning the housing space into a first toner chamber 32*a* located on one side Y1 with respect to the second direction Y and a second toner chamber 32*b* located on the other side Y2 with respect to the second direction Y. The partition plate 31 is so formed as to extend across a ceiling portion 27 of the enclosure 16 located on the upper side Z1 with respect to the vertical direction Z and a bottom portion 28 of the enclosure 16 located on the lower side Z2 with respect to the vertical direction Z, and is also so formed as to elongate between the first direction X-wise side surfaces 33*a* and 33*b* of the enclosure 16, with each of the end regions of the enclosure 16 in the first direction X kept as a partition plate 31-free region. Between the partition plate 31 and one side surface 33*a* of the enclosure 16 located on one side X1 with respect to the first direction X is formed a first communication opening 34*a* for providing communication between the first toner chamber 32*a* and the second toner chamber 32*b*. Moreover, between the partition plate 31 and the other side surface 33*b* of the enclosure 16 located on the other side X2 with respect to the first direction X is formed a second communication opening 34*b* for providing communication between the first toner chamber 32*a* and the second toner chamber 32*b*.

The first and second toner conveyor rollers 21 and 22 correspond to the agitating/conveying member and are, just like the magnet roller 23, rotatably supported at both ends of the enclosure 16 in the first direction X, with their axes of rotation arranged in parallel with the first direction X. The first toner conveyor roller 21 is placed in the first toner chamber 32*a*, whereas the second toner conveyor roller 22 is placed in the second toner chamber 32*b*. The first and second toner conveyor rollers 21 and 22 have screws 35 and 36, respectively, for conveying toner with agitation. Moreover, the first and second toner conveyor rollers 21 and 22 have driving gears 37 and 38, respectively, that are engaged in a mutual manner with the side of the other side surface 33*b* of the enclosure 16 located on the other side X2 with respect to the first direction X. The first and second toner conveyor rollers 21 and 22 are rotatably driven, via the driving gears 37 and 38, respectively, by a driving motor. Further, the first and second toner conveyor rollers 21 and 22 have, at their ends on the downstream side in a toner conveying direction inside the enclosure 16, toner receiving plates 41 and 42, respectively, formed in proximity to the bearing of the enclosure 16. The toner receiving plates 41 and 42 are each annular-shaped and are fitted to the first and second toner conveyor rollers 21 and 22, respectively. As the first and second toner conveyor rollers 21 and 22 are rotated, so the toner receiving plates 41 and 42 are rotated thereby to prevent toner from becoming stagnant at both end portions of the housing space in the first direction X.

The toner introducing pipe 17 is connected to the end portion of the ceiling portion 27 of the enclosure 16 located on one side X1 with respect to the first direction X, as well as located on one side Y1 with respect to the second direction Y. At the end portion of the ceiling portion 27 of the enclosure 16 located on one side X1 with respect to the first direction X, as well as located on one side Y1 with respect to the second direction Y, is formed a toner introducing port 43 that is an opening which communicates with the opening 20 formed at the end of the toner introducing pipe 17 located on the lower side Z2 with respect to the vertical direction Z. Toner is introduced into the first toner chamber 32*a* of the housing portion 13 through the toner introducing port 43.

The toner that has been introduced through the toner introducing port 43 is, along with the carrier, conveyed in the first toner chamber 32*a* to the other side X2 with respect to the first direction X while being agitated by the first toner convey or roller 21, and then passes through the second communication opening 34*b* to enter the second toner chamber 32*b*. The toner that has been conveyed to the second toner chamber 32*b* is further conveyed in the second toner chamber 32*b* to one side X1 with respect to the first direction X, and then passes through the first communication opening 34*a* to enter the first toner chamber 32*a*. That is, the first toner chamber 32*a*, the second communication opening 34*b*, the second toner chamber 32*b*, and the first communication opening 34*a* constitute a circulation path through which the toner is circulated inside the housing portion 13. In FIG. 3, the toner and the carrier are circulated through the circulation path formed inside the enclosure 16, in a counterclockwise direction, by the first and second toner conveyor rollers 21 and 22. In this way, the toner that has been introduced through the toner introducing port 43 is conveyed to the magnet roller 23 while being agitated by the first and second toner conveyor rollers 21 and 22.

The housing portion 13 is further provided with a magnetic permeability sensor 45 which is included in the concentration measurement section for performing a concentration measurement operation to measure the concentration of toner in the housing portion 13. The magnetic permeability sensor 45 serves also as the concentration measurement section. The magnetic permeability sensor 45 is designed to measure the magnetic permeability of a developer. The magnetic permeability of a developer is dependent on the concentration of toner. Specifically, the higher is the concentration of toner, the lower is the magnetic permeability of a developer; that is, the lower is the concentration of toner, the higher is the magnetic permeability of a developer. Accordingly, by measuring the magnetic permeability of a developer, it is possible to measure the concentration of toner. In a case of measuring the concentration of the toner in the vicinity of the toner introducing port 43, since the toner and the carrier are not blended together completely, it is impossible to achieve toner concentration measurement with accuracy. Furthermore, in a case of measuring the concentration of the toner at a location spaced from the toner introducing port 43 on the downstream side in the toner conveyance direction, even if toner is introduced through the toner introducing port 43, the introduction of the toner is not immediately reflected in the toner concentration detected by the magnetic permeability sensor 45, which results in a time delay. In light of the foregoing, in the present embodiment, the magnetic permeability sensor 45 performs magnetic permeability measurement at a location in the closest vicinity to the toner introducing port 43 on the downstream side in the toner conveyance direction, where the toner and the carrier have been blended together completely. In this case, it is possible to minimize the time delay in reflection of the replenishment of toner in the result of toner concentration measurement as much as possible, and also to achieve toner concentration measurement with accuracy. To be specific, the magnetic permeability sensor 45 is disposed approximately centrally of the first toner chamber 32*a* in the first direction X so as to perform magnetic permeability measurement at a location at which the toner that has been introduced through the toner introducing port 43 arrives in 7 to 9 seconds after the introduction.

As has already been described, while the developer is circulated through the circulation path formed in the housing portion 13, the toner of the developer is consumed at the photoreceptor drum 15 by way of the magnet roller 23, and the replenishment of toner is effected through the toner introducing port 43. In this case, the concentration of toner detected by the magnetic permeability sensor 45 exhibits timewise periodicity. The time period T for the concentration of toner is substantially equal to the time U taken for the toner to make a one round through the circulation path formed in the housing portion 13. The time period T for the concentration of toner or the time U taken for the toner to make a one round through the circulation path is set to be approximately 22 seconds in this embodiment.

In this embodiment, the magnetic permeability sensor 45 is so implemented as to include an A/D converter, and produces output of an electrical signal indicating the magnetic permeability of the developer in the form of an 8-bit numerical value, namely, an integer value ranging from 0 to 255. In this embodiment, in order to widen the range of magnetic permeability that can be presented by the A/D converter, output of the concentration of toner which is ought to be followed, namely ideal magnetic permeability, is produced as 128. Moreover, in this embodiment, the higher is the numerical value outputted from the magnetic permeability sensor 45, the higher is the magnetic permeability. As has already been described, the higher is the magnetic permeability of a developer, the lower is the concentration of toner. Therefore, the lower is the numerical value outputted from the magnetic permeability sensor 45, the higher is the concentration of toner. That is, when the numerical value outputted from the magnetic permeability sensor 45 is lower than 128, it is found that the concentration of the toner within the housing portion 13 is higher than the to-be-followed toner concentration, and, on the other hand, when the numerical value outputted from the magnetic permeability sensor 45 is higher than 128, it is found that the concentration of the toner within the housing portion 13 is lower than the to-be-followed toner concentration.

The blade 24 is so formed as to extend across both ends of the enclosure 16 in the first direction X, and is arranged along the magnet roller 23. A predetermined spacing is secured between the blade 24 and the magnet roller 23. The developer is provided to the photoreceptor drum 15 through the spacing in an amount corresponding to the spacing.

The toner replenishing apparatus 11 is so constructed as to include a toner bottle 26. The toner bottle 26 accommodates therein any of cyan (C)-color toner, magenta (M)-color toner, yellow (Y)-color toner, and black (B)-color toner. In the image forming apparatus 14, in this embodiment, there are disposed four units of the development apparatuses 12, individual ones of which receive the replenishment of the cyan (C)-color toner, the replenishment of the magenta (M)-color toner, the replenishment of the yellow (Y)-color toner, and the replenishment of the black (B)-color toner, respectively.

The toner replenishing apparatus 11 has a toner discharge port, a shutter mechanism, and a toner motor 46. The toner discharge port communicates with the opening 19 formed in the upper part of the toner introducing pipe 17 located on the upper side Z1 with respect to the vertical direction Z. The shutter mechanism allows selection between an opened state and a closed state for the toner discharge port. The toner motor 46 drives the toner bottle 26 to turn in synchronization with the shutter mechanism. In the opened state, the toner motor 46 is actuated to "ON", whereupon the toner bottle 26 is turned. In the closed state, the toner motor 46 is actuated to "OFF", whereupon the turning of the toner bottle 26 comes to a halt. Upon the toner discharge port being brought into the opened state by the shutter mechanism, the toner bottle 26 is turned by the toner motor 46, and toner is thereupon fed into the housing portion 13 through the toner introducing pipe 17. On the other hand, upon the toner discharge port being brought into the closed state by the shutter mechanism, the turning of the toner bottle 26 comes to a halt, and the replenishment of toner to the housing portion 13 is no longer effected. The shutter mechanism and the toner motor 46 are operated under the control of a control unit which will hereinafter be described so as for a predetermined amount of toner to be fed into the housing portion 13.

The toner replenishing apparatus 11 is further provided with the control unit and a storage unit. The control unit and the storage unit serve also as a control unit and a storage unit, respectively, of the image forming apparatus 14. The control unit is implemented by the use of a central processing unit (CPU for short). The storage unit is so implemented as to include ROM (Read Only Memory) and RAM (Random Access Memory). Through the reading and execution of a control program stored in the storage unit, as shown in FIG. 1, the control unit functions as a control coefficient value setting section 51, a toner concentration control section 52, a pixel count section 53, and a control coefficient value correlation table 54.

The pixel count section 53 receives input of CMYK signals obtained by subjecting image data produced by an image reading apparatus 61, which will hereinafter be described, to halftone correction or the like process in the control unit of the image forming apparatus 14. On the basis of the CMYK signals, the image forming apparatus 14 effects image formation and printing operations. The CMYK signals include data indicating the tones of the individual colors: cyan, magenta, yellow, and black. The pixel count section 53 corresponds to the consumption calculation section for performing a consumption calculation operation to calculate the amount of toner consumption. In the pixel count section 53, a value corresponding to the amount of consumption of each of the toners of different colors CMYK is calculated in a pixel-by-pixel manner, and a coverage rate is calculated on the basis of the calculated value.

The pixel count section 53 is so constructed as to include a count portion 55, a weighting computation portion 56, a weighting coefficient table 57, and a coverage rate calculating portion 58. In regard to the operations to be performed by the pixel count section 53 as set forth hereunder, every process is carried out for each of the CMYK colors on an individual basis.

The count portion 55 keeps count of the tones of the individual colors in a pixel-by-pixel manner on the basis of the signal input values included in the CMYK signals. In terms of the signal input value, for example, in a case of a 16-tone form, the tone of each color is represented by an integer value ranging from 0 to 15, and, on the other hand, in a case of a 256-tone form, the tone of each color is represented by an integer value ranging from 0 to 255.

The weighting computation portion 56 performs weighting on the tone values counted by the count portion 55 in a pixel-by-pixel manner. Since the amount of toner consumption varies according to the tone value, by performing weighting, it is possible to obtain the amount of toner consumption for each tone value on an individual basis. To be specific, in the weighting computation portion 56, a weighting coefficient which corresponds to the tone value counted by the count portion 55 is retrieved from the weighting coefficient table 57, and the retrieved weighting coefficient and the counted tone value are multiplied together.

In the weighting coefficient table 57 are stored weighting coefficients corresponding to the respective tone values. Shown in Table 1 is the relationship between the weighting coefficient and the signal input value stored in the weighting coefficient table 57 by way of example in a case of the 16-tone form.

TABLE 1

| | Signal input value | Weighting coefficient |
|---|---|---|
| Area 1 | 0-4 | 0 |
| Area 2 | 5-8 | 1 |
| Area 3 | 9-12 | 3 |
| Area 4 | 12-15 | 4 |

In the example shown in Table 1, the figures 0 to 15 that are for the signal input value to represent 16 tones are classified under four areas. The tone values in each of the areas are assigned with a predetermined weighting coefficient. For example, in a case where the signal input value is given by a figure "10", the signal input value is included in Area 3.

Therefore, in the weighting computation portion 56, the signal input value "10" is multiplied by the weighting coefficient "3" corresponding to Area 3 (10×3) whereupon a numerical value "30" is outputted.

Figure 4:
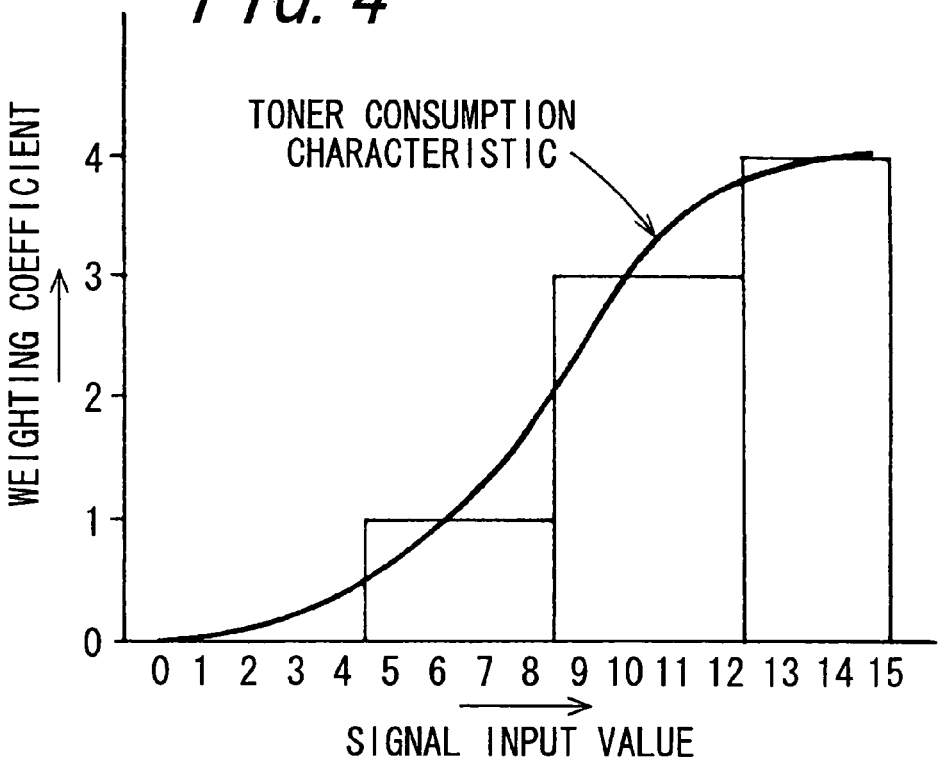
FIG. 4 is a graph showing the relationship between the weighting coefficient and the characteristic of toner consumption.

FIG. 4 is a graph showing the relationship between the weighting coefficient and the characteristic of toner consumption. In the graph, the signal input value is taken along the horizontal axis, and the weighting coefficient is taken along the vertical axis. The toner consumption characteristic drawn by a solid line represents the relationship between the signal input value designating a toner value and the amount of toner consumption. In FIG. 4, the scales of the vertical axis for the toner consumption characteristic are so determined that the value representing the highest toner consumption and the maximum value (numerical value 4) of the weighting coefficient coincide with each other. In order for the amount of toner consumption to be indicated as precisely as possible, the weighting coefficients are so determined that the sum total of the areas of rectangular portions coincides substantially with the area of the region between the curve representing the toner consumption characteristic and the horizontal axis. In this way, the weighting coefficient is correlated with the toner consumption characteristic. Accordingly, the value weighted by the weighting computation portion 56 indicates the amount of consumption of each of the toners of different colors in a pixel-by-pixel manner with accuracy.

The coverage rate calculating portion 58 calculates a page-by-page coverage rate. To be specific, in the coverage rate calculating portion 58, at first, the numerical values obtained by computation in the weighting computation portion 56 are totalized for each page subjected to printing performed by the image forming apparatus 14 on an individual basis. The integrated value thus obtained corresponds to the amount of toner to be consumed at the time of printing 1 page. Next, a value obtained by dividing the integrated value by the highest integrated value is multiplied by 100. Note that the highest integrated value is equal to a value corresponding to the amount of toner consumed at the time of printing 1 page with the highest tone value, which is obtained by multiplying a numerical value derived by multiplying together the weighting coefficient corresponding to the highest tone value (numerical value 4) and the highest tone value (numerical value 15) (=4×15) by a 1 page-corresponding pixel number. Accordingly, as the coverage rate approaches 100, the amount of toner consumption grows higher.

The control coefficient value setting section 51 determines, on the basis of the coverage rate representing the amount of toner consumption, a stop threshold value S2 representing a reference concentration for the replenishment of toner to the housing portion 13, and replenishment extension time A for continuing the replenishment of toner to the housing portion 13 after the concentration of toner reaches the reference concentration. To be specific, in the control coefficient value setting section 51, the stop threshold value S2 and the replenishment extension time A corresponding to the coverage rate are determined with reference to the control coefficient value correlation table 54. The control coefficient value setting section 51 corresponds to the setting section for performing a setting operation.

Table 2 shows the correlation among the coverage rate stored in the control coefficient value correlation table 54, the stop threshold value S2, and the replenishment extension time A. Note that a start threshold value S1, which represents a predetermined replenishment starting concentration with which the replenishment of toner to the housing portion 13 is started, is determined in advance. In this embodiment, the start threshold value S1 is set at "128", which is a numerical value representing the ideal magnetic permeability.

TABLE 2

| Coverage rate | Stop threshold value S2 | A (second) |
|---|---|---|
| 0-10 | 128 | 0 |
| 11-20 | 128 | 0 |
| 21-30 | 128 | 0 |
| 31-40 | 124 | 8 |
| 41-50 | 120 | 8 |
| 51-60 | 120 | 8 |
| 61-70 | 120 | 8 |
| 71-80 | 120 | 8 |
| 81-90 | 120 | 8 |
| 91-100 | 120 | 8 |

As will be described later, the amount of toner to be replenished is prescribed in accordance with the differential between the start threshold value S1 and the stop threshold value S2 and with the replenishment extension time A. Since the stop threshold value S2 and the replenishment extension time A are determined in accordance with the coverage rate representing the amount of toner consumption in that way, it follows that the amount of toner to be replenished is determined in accordance with the coverage rate. The replenishment extension time A is set at a value of 0 second when the amount of toner consumption is less than a predetermined value, and is set at a value of greater than 0 second when the amount of toner consumption exceeds the predetermined value. In this embodiment, the predetermined value for the amount of toner consumption is selected as a value corresponding to the amount of toner to be consumed at the time when the coverage rate takes on a value of 31. In this embodiment, so long as the coverage rate falls in a range of from 0 to 30, the start threshold value S1 and the stop threshold value S2 are identical and set at 128, respectively, that represents the ideal magnetic permeability. Moreover, the replenishment extension time A is set at 0 second. In a case where the coverage rate is equal to or greater than 31 and thus the amount of toner consumption becomes larger, the stop threshold value S2 and the replenishment extension time A are so determined that the amount of toner to be replenished is increased with increasing coverage rate. Moreover, as has already been described, the higher is the numerical value outputted from the magnetic permeability sensor 45, the lower is the concentration of the toner in the housing portion 13. Accordingly, the stop threshold value S2 is set to be equal to or less than the start threshold value S1 so as for the reference concentration to be equal to or greater than the replenishment starting concentration. Further, with respect to the time period T for the variation of toner concentration with time detected by the magnetic permeability sensor 45, the replenishment extension time A is so selected as to fulfill the following formula (1). As has already been described, the time period T is substantially equal to the time U taken for the toner to make a one round through the circulation path formed in the housing portion 13.

$$0 \leqq A \leqq 3 \cdot T/4 \quad (1)$$

More preferably, the replenishment extension time A is so selected as to fulfill the following formula (2) when the amount of toner consumption is equal to or greater than the predetermined value (when the coverage rate is equal to or greater than 31 in the case of this embodiment)

$$T/4 \leqq A \leqq T/2 \quad (2)$$

Still more preferably, the replenishment extension time A is so selected as to fulfill the following formula (3) when the amount of toner consumption is equal to or greater than the predetermined value (when the coverage rate is equal to or greater than 31 in the case of this embodiment).

$$A=3\cdot T/8 \quad (3)$$

The magnetic permeability sensor 45 acts to provide the toner concentration control section 52 with an electrical signal indicating the measured magnetic permeability of the developer in the housing portion 13.

On the basis of the electrical signal provided from the magnetic permeability sensor 45, the toner concentration control section 52 starts the replenishment of toner to the housing portion 13 when the concentration of toner is declined to or below the toner concentration represented by the start threshold value S1, and stops the replenishment of toner to the housing portion 13 at a time following the lapse of the replenishment extension time A from the time at which the concentration of toner reached the toner concentration represented by the stop threshold value S2. To be specific, when the numerical value outputted from the magnetic permeability sensor 45 varies from a value of less than the start threshold value S1 to a value of equal to or greater than the start threshold value S1, then the toner concentration control section 52 effects control of the shutter mechanism of the toner replenishing apparatus 11 in a manner so as to change the toner discharge port of the toner bottle 26 from the closed state to the opened state. On the other hand, at a time following the lapse of the replenishment extension time A from the time at which the numerical value outputted from the magnetic permeability sensor 45 varied from a value of greater than the stop threshold value S2 to the stop threshold value S2, then the toner concentration control section 52 effects control of the shutter mechanism of the toner replenishing apparatus 11 in a manner so as to change the toner discharge port of the toner bottle 26 from the opened state to the closed state. The toner concentration control section 52 corresponds to the toner concentration adjustment section for performing a toner concentration adjustment operation.

Figure 5:
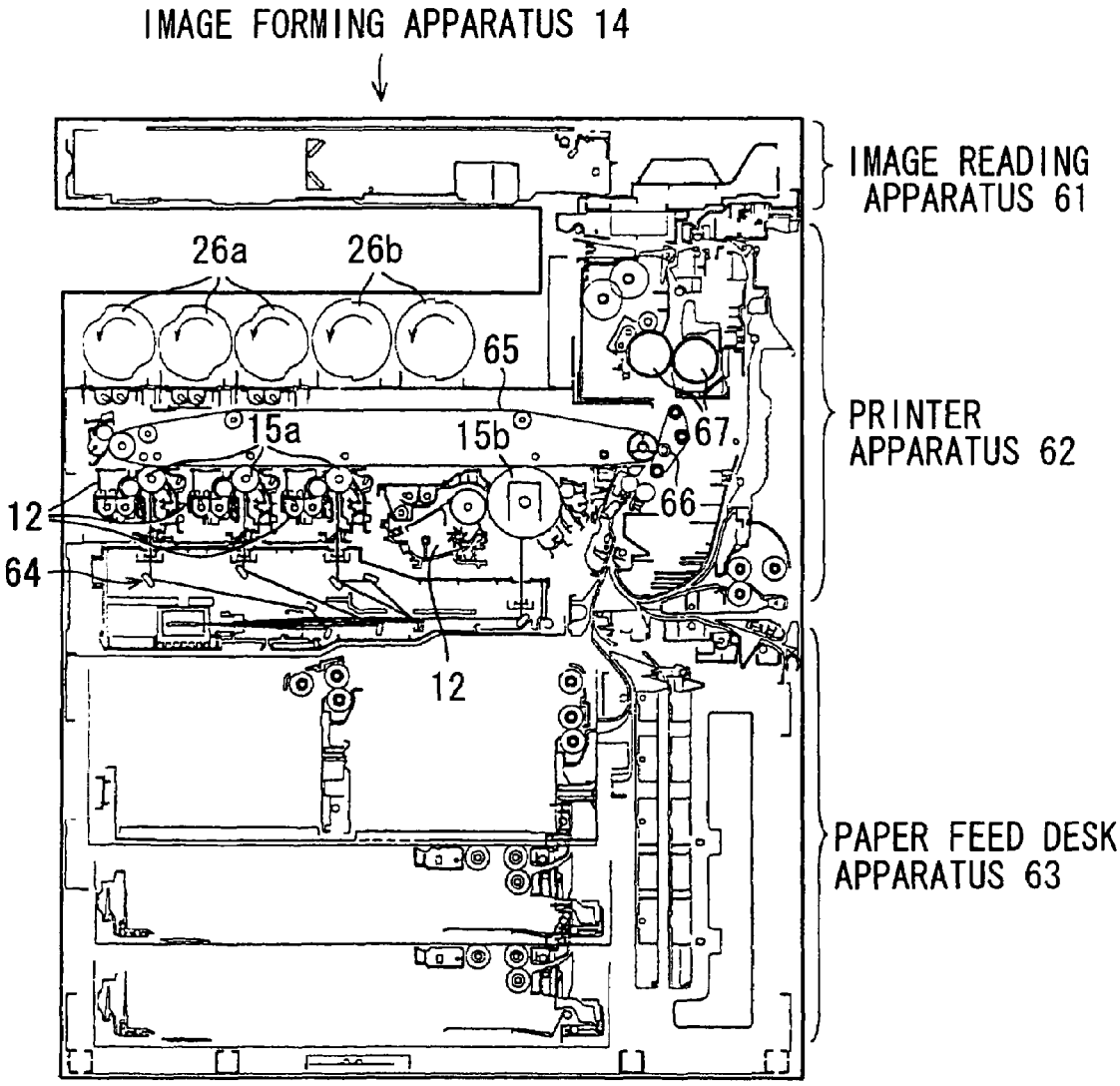
FIG. 5 is a sectional view showing the image forming apparatus in which is incorporated the toner replenishing apparatus.

FIG. 5 is a sectional view showing the image forming apparatus 14 in which is incorporated the toner replenishing apparatus 11. The image forming apparatus 14 is so constructed as to include the image reading apparatus 61 for reading image data from an original by means of a CCD (Charge Coupled Device) image sensor or otherwise, a printer apparatus 62 for forming an image on a paper sheet on the basis of image data produced by the image reading apparatus 61, and a paper feed desk apparatus 63 for feeding paper sheets to the printer apparatus 62 one after another.

The printer apparatus 62 is composed of three pieces of photoreceptor drums 15*a* for different colors that correspond to magenta, cyan, and yellow, respectively, a photoreceptor drum 15*b* for black color that is made larger in size than the three color-adaptable photoreceptor drums 15*a*, and four units of the development apparatuses 12, each of which provides its respective photoreceptor drum 15 with toner of corresponding color. Each of the photoreceptor drums 15 effects recording of an electrostatic latent image. The printer apparatus 62 is further provided with an optical unit (LSU) 64 for writing an electrostatic latent image on each of the photoreceptor drums 15, a transfer belt 65 which is disposed in abutment with each of the photoreceptor drums 15, a secondary transfer unit 66, a fixing roller 67, a charging device, a cleaning device, a transfer device, and so forth.

Moreover, the printer apparatus 62 has, above the upper parts of the individual photoreceptor drums 15 located on the upper side Z1 with respect to the vertical direction Z, three pieces of toner bottles 26*a* for different colors that accommodate magenta-color toner, cyan-color toner, and yellow-color toner, respectively, and two pieces of toner bottles 26*b* for black color that accommodate black-color toner. The black color-adaptable toner bottles 26*b* are each made a size larger than the three color-adaptable toner bottles 26*a*. Also disposed in the printer apparatus 62 are four units of the toner replenishing apparatuses 11 constructed so as to include their respective toner bottles 26*a* and 26*b*. The toner bottles 26*a* and 26*b* are each so disposed as to be attachable to and detachable from the image forming apparatus 14. The toner bottles 26*a* and 26*b* can be replaced with the new ones separately one by one following the consumption of the toners accommodated therein.

Toner is supplied from the toner replenishing apparatus 11 to the development apparatus 12, and is then fed therefrom to each of the photoreceptor drums 15, whereupon a toner image is formed on the photoreceptor drum 15. The toner images thus formed are superimposedly transferred onto the transfer belt 65 one after another, and the superimposed toner images are transferred onto a paper sheet fed from the paper feed desk apparatus 63 by the secondary transfer unit 66. Upon the paper sheet passing through the fixing roller 67 disposed downstream from the secondary transfer unit 66 in the direction in which the paper sheet is conveyed, the toner image transferred onto the paper sheet is fixed into place. After that, the paper sheet bearing the image formed thereon is discharged from the image forming apparatus 14.

Figure 6:
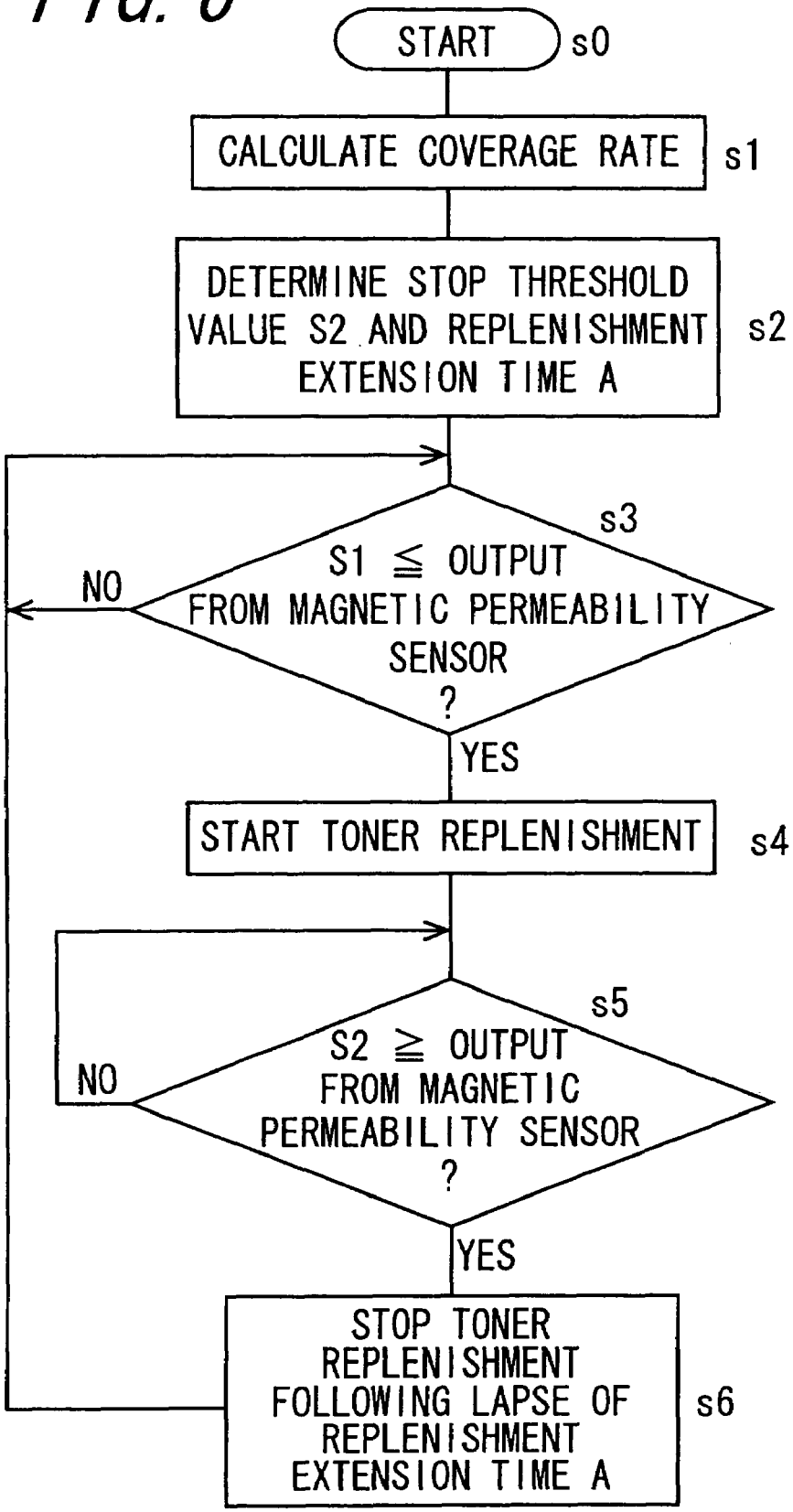
FIG. 6 is a flow chart showing a procedure to be followed by the toner replenishing apparatus in performing a toner replenishing operation.

FIG. 6 is a flow chart showing a procedure to be followed by the toner replenishing apparatus 11 in performing a toner replenishing operation. The image reading apparatus 61 produces image data by reading an original, and the produced image data is subjected to halftone correction or the like process in the control unit of the image forming apparatus 14 thereby to produce CMYK signals. Upon input of the CMYK signals to the pixel count section 53, the image forming apparatus 14 starts a printing operation. At the instant when a new 1 job is started following the completion of the previous 1 job, the procedure proceeds from Step s0 to Step s1. Note that the term "1 job" refers to a sequence of operations involving a step of reading image data of an original once, a step of producing a user-specified number of prints based on the read-in image data, and a step of discharging the printed paper sheets.

In Step s1, on the basis of the CMYK signals, the pixel count section 53 calculates a coverage rate for each color on an individual basis. Then, the procedure proceeds to Step s2. In Step s2, on the basis of the coverage rate, the control coefficient value setting section 51 determines the stop threshold value S2 and the replenishment extension time A. Then, the procedure proceeds to Step s3.

In Step s3, the toner concentration control section 52 makes a judgment whether the signal value provided from the magnetic permeability sensor 45 is greater than (or equal to) the start threshold value S1 or not. When the signal value is found to be smaller than the start threshold value S1, it is determined that the concentration of toner falls within an appropriate range. In this case, the operation in Step s3 is repeated every 0.3 seconds, for example. That is, the judgment operation in Step s3 is repeated, without starting the replenishment of toner, until the signal value provided from the magnetic permeability sensor 45 becomes equal to or greater than the start threshold value S1. In the toner concentration control section 52, at the instant when the signal value provided from the magnetic permeability sensor 45 is found to be equal to or greater than the start threshold value S1, it is determined that the concentration of toner is lowered due to execution of a printing operation. Then, the procedure proceeds to Step s4.

In Step s4, the toner concentration control section 52 effects control of the shutter mechanism of the toner replenishing apparatus 11 in a manner so as to bring the toner discharge port into the opened state, whereupon the replenishment of toner to the housing portion 13 is started. Then, the procedure proceeds to Step s5.

In Step s5, the toner concentration control section 52 makes a judgment whether the signal value provided from the magnetic permeability sensor 45 is smaller than (or equal to) the stop threshold value S2 or not. When the signal value is found to be greater than the stop threshold value S2, the operation in Step s5 is repeated, for example, every 0.3 seconds, while maintaining the replenishment of toner. That is, the replenishment of toner is continued until the signal value provided from the magnetic permeability sensor 45 becomes equal to or less than the stop threshold value S2. In the toner concentration control section 52, at the instant when the signal value provided from the magnetic permeability sensor 45 is found to be equal to or less than the stop threshold value S2, it is determined that the concentration of toner reached the reference concentration because of the replenishment of toner. Then, the procedure proceeds to Step s6.

In Step s6, at a time following the lapse of the replenishment extension time A from the time at which the signal value varied from a value of greater than the stop threshold value S2 to the stop threshold value S2, the toner concentration control section 52 effects control of the shutter mechanism of the toner replenishing apparatus 11 in a manner so as to bring the toner discharge port into the closed state, whereupon the replenishment of toner is brought to a stop. Next, the procedure proceeds to Step s3, and the operations in Step s3 through Step s6 are carried out. At the completion of 1 job; that is, at that point in time when a specified number of prints were produced after the image data reading process, any of the operation of Step s3, the operation of Step s5, and the operation of Step s6 is in effect. Subsequent to that, when there comes input of new 1 job, the operation of the step that is in effect at the completion of the previous 1 job is continued, and simultaneously the operations in Step s1 and Step s2 are carried out. At this time, the stop threshold value S2 and the replenishment extension time A that have been newly determined in Step s2 replace the current ones, and the judgment operation in Step s3 or Step s5 is carried out continuously, and the procedure proceeds to Step s6 in turn, whereupon the procedure comes to an end. Then, the procedure returns to step s3 once again where the judgment as to whether the replenishment of toner is started or not is made repeatedly.

In the control coefficient value setting section 51, the stop threshold value S2 and the replenishment extension time A are determined in accordance with the amount of toner consumption. In this way, the amount of toner to be replenished is determined in accordance with the amount of toner consumption. On the basis of the stop threshold value S2 and the replenishment extension time A thus determined and also the start threshold value S1, the toner concentration control section 52 exercises toner replenishment control. In this embodiment, the magnet roller 23 at which toner is consumed and the location where toner concentration measurement is achieved by the action of the magnetic permeability sensor 45 are separated from each other. Therefore, there is a time delay of about 15 seconds in an actually detected concentration with respect to the concentration corresponding to the position of the magnet roller 23. In this case, as the amount of toner consumption is increased, a ripple is caused in the concentration of toner. However, so long as there is a sufficiently large differential between the start threshold value S1 representing the replenishment starting concentration and the stop threshold value S2 representing the reference concentration and also the replenishment extension time A is sufficiently long, then the replenishment of toner can be continued without repeating ON/OFF switching operations for the toner motor 46. This helps narrow the range of variation in the concentration of toner, namely the range of ripple. Thus, by continuing the replenishment of toner while the amount of toner consumption is large, it is possible to keep the range of variation in the concentration of the toner in the housing portion 13 narrow regardless of the amount of toner consumption.

Moreover, in this embodiment, in a case where the coverage rate falls in a range of from 0 to 30, the stop threshold value S2 is set at 128 and the replenishment extension time A is set at 0 second in Step s2. In this case, as the concentration of the toner in the housing portion 13 is lowered due to toner consumption, and eventually, at the instant when the magnetic permeability exceeds the start threshold value S1, the replenishment of toner to the housing portion 13 is started. With a low consumption of toner, a ripple hardly occurs in the concentration of toner. After some period of time has elapsed while the replenishment of toner was continued, the concentration of the toner in the housing portion 13 is caused to rise, and the magnetic permeability is decreased correspondingly. Then, upon the stop threshold value S2 being reached, the replenishment of toner is brought to a stop. Accordingly, even if the start threshold value S1 and the stop threshold value S2 are set at the same value and also the replenishment extension time A is set at 0 second, the replenishment of toner can be achieved without causing any problem.

Moreover, the coverage rate representing the amount of toner consumption is calculated on the basis of a pixel-by-pixel tone and the amount of toner consumption. In this case, as compared with the case of calculating the amount of toner consumption in a simple manner with no consideration given to tones, it is possible to obtain the amount of toner consumption more accurately. On the basis of the amount of toner consumption thus obtained with accuracy, the stop threshold value S2 and the replenishment extension time A are determined. This makes it possible to replenish toner in response to the amount of toner actually consumed, and thereby narrow the range of variation in the concentration of the toner within the housing portion 13.

Moreover, in the control coefficient value setting section 51, the stop threshold value S2 and the replenishment extension time A are determined with reference to the control coefficient value correlation table 54 showing the correlation between the coverage rate representing the amount of toner consumption, and the stop threshold value S2 and the replenishment extension time A. This eliminates the need to calculate the stop threshold value S2 and the replenishment extension time A on the basis of the coverage rate in a sequential manner. Accordingly, the process of determining the stop threshold value S2 and the replenishment extension time A can be carried out with lesser degree of burdens.

Further, the replenishment extension time A is so selected that the formula (1) is fulfilled, and preferably the formula (2) is fulfilled, and more preferably the formula (3) is fulfilled, with respect to the periodic time variation T. On the basis of the replenishment extension time A thus selected, the start threshold value S1, and the stop threshold value S2, the replenishment of toner to the housing portion 13 is effected. In this way, the range of periodic variation in the concentration of toner can be narrowed.

In a case of adopting a conventional toner replenishing method in which, where the coverage rate falls in a range of from 31 to 100, the start threshold value S1 and the stop threshold value S2 are set at the same value and the replenishment extension time A is set at 0 second, a ripple occurs in the concentration of toner, which makes it impossible to effect the replenishment of toner continuously. Hereafter, with reference to FIG. 7, a description will be given as to toner replenishment control which is exercised at the time of effecting the replenishment of toner, where the coverage rate falls in a range of from 31 to 100, by using the toner replenishing apparatus 11 of this embodiment.

Figure 7:
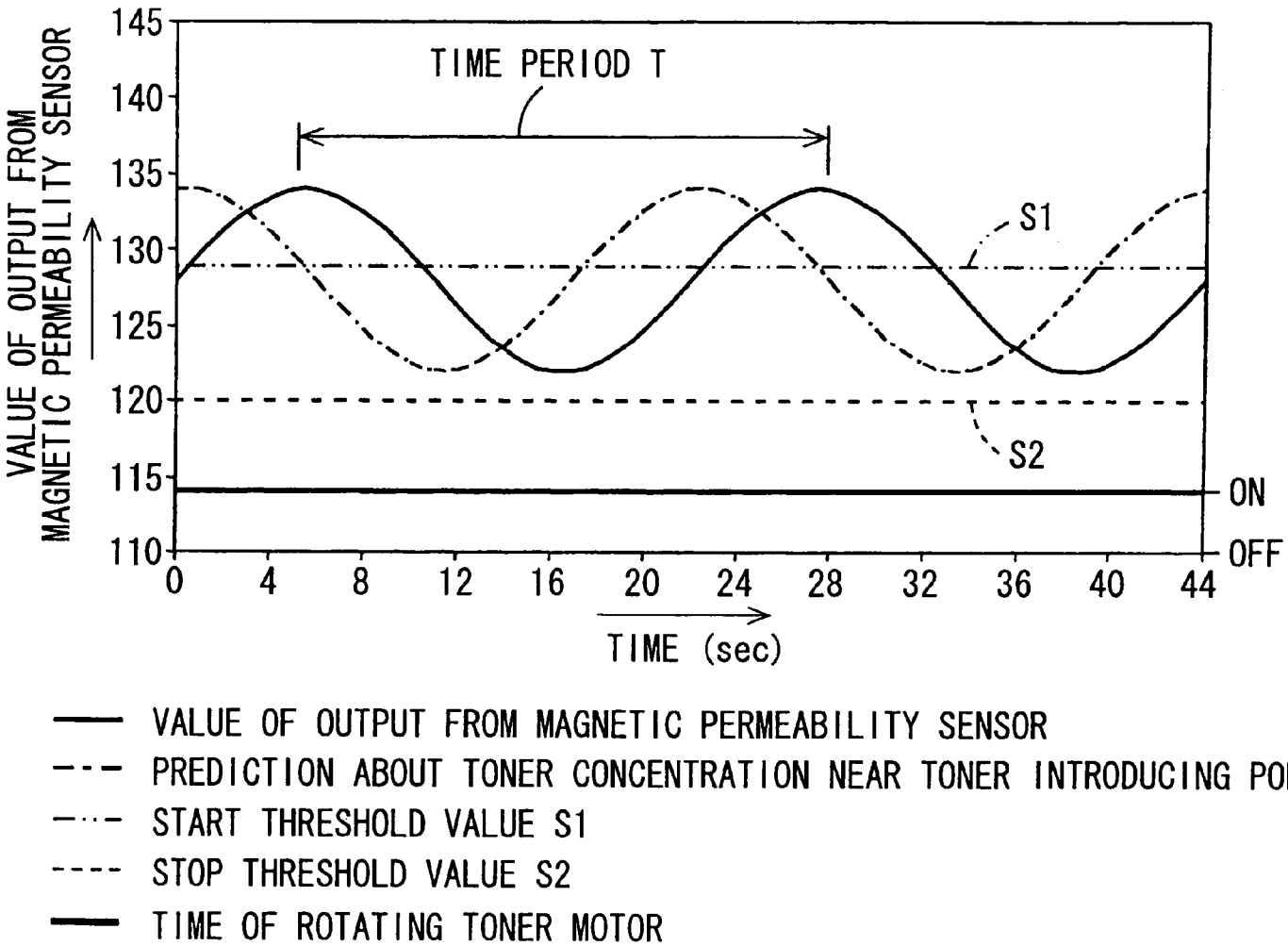
FIG. 7 is a view showing, by way of implemented example, the variation of the value of output from the magnetic permeability sensor with respect to time, as observed when the coverage rate stands at 70%.

FIG. 7 is a view showing, by way of implemented example, the variation of the value of output from the magnetic permeability sensor 45 with respect to time, as observed when the coverage rate stands at 70%. On the other hand, FIG. 10, which has already been presented in connection with the background art, is a view showing, by way of comparative example, the variation of the value of output from the magnetic permeability sensor 45 with respect to time, as observed when the coverage rate stands at 70% under the condition that the start threshold value S1 and the stop threshold value S2 are set at the same value and also the replenishment extension time A is set at 0 second. In both of FIGS. 7 and 10, temporal variations of ON/OFF of the toner motor 46 are also shown. Moreover, in both of FIGS. 7 and 10, when the value of output from the magnetic permeability sensor 45 stands at 114, it is indicated that the toner motor 46 is kept in the ON state, whereas, when the value of output from the magnetic permeability sensor 45 stands at 110, it is indicated that the toner motor 46 is kept in the OFF state. As shown in FIG. 7, in the implemented example, in the case of 70% coverage rate, the start threshold value S1 is set at 128, the stop threshold value S2 is set at 120, and the replenishment extension time A is set at 8 seconds. When the coverage rate is as high as 70%, even if the replenishment of toner is effected, it never occurs that the value of output from the magnetic permeability sensor 45 falls below the stop threshold value S2. With a repeat of the operation in Step s5, the replenishment of toner can be continued. In this case, since the switching between the ON and OFF states of the toner motor 46 is not repeated, in contrast to the case of the related art shown in FIG. 10, it is possible to narrow the range of variation in the concentration of the toner within the housing portion 13. Moreover, FIG. 7 also shows predicted values for the concentration of toner as observed at the toner introducing port 43. Since the toner introducing port 43 is arranged upstream from the location where a measurement operation is performed by the magnetic permeability sensor 45, there is a time advance of approximately 8 seconds in the toner concentration predicted value as observed at the toner introducing port 43 with respect to the variation of the value of output from the magnetic permeability sensor 45.

Figure 8:
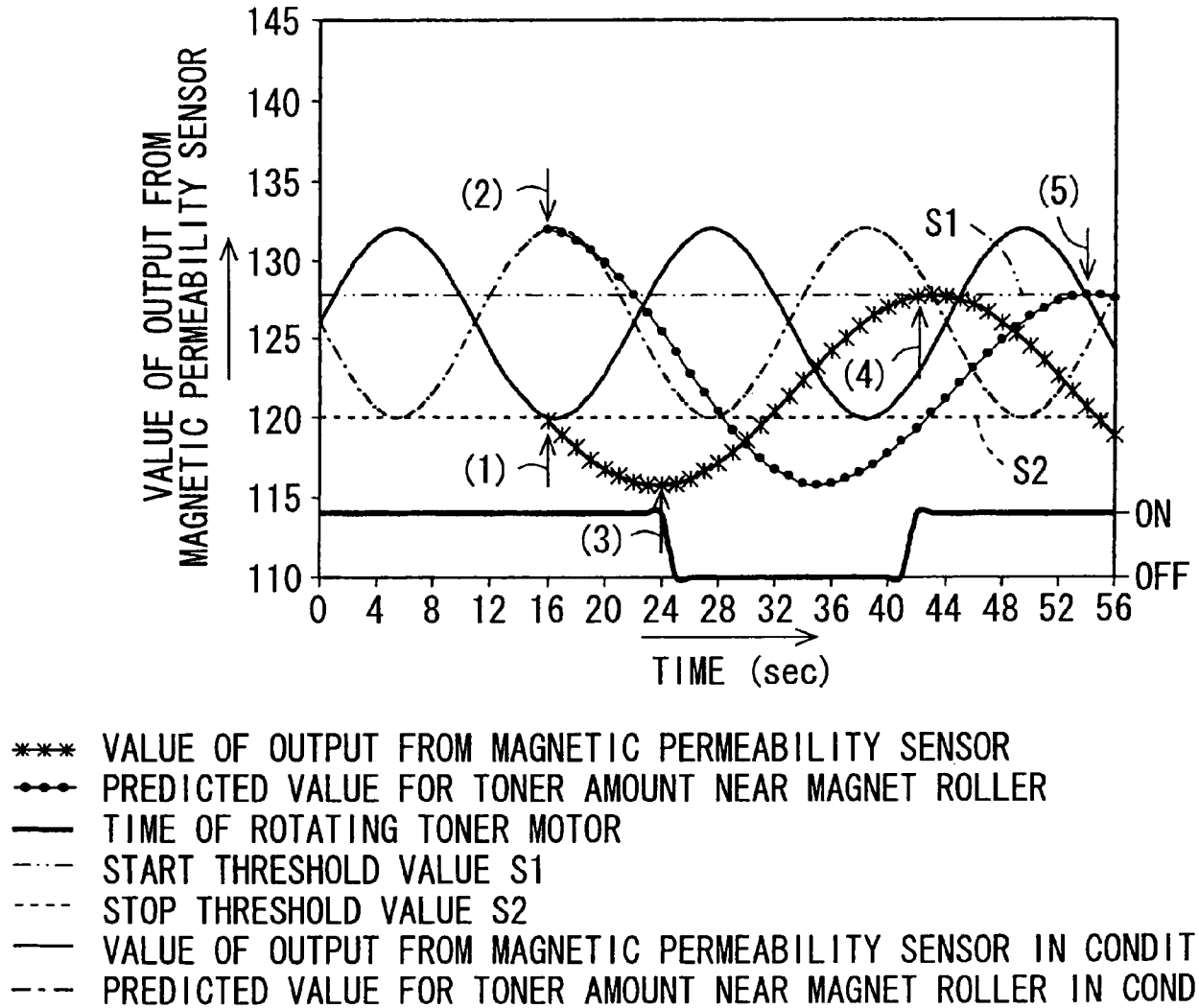
FIG. 8 is a view showing the variation of the value of output from the magnetic permeability sensor with respect to time, as observed when the replenishment of toner is effected during the replenishment extension time A.
Figure 9:
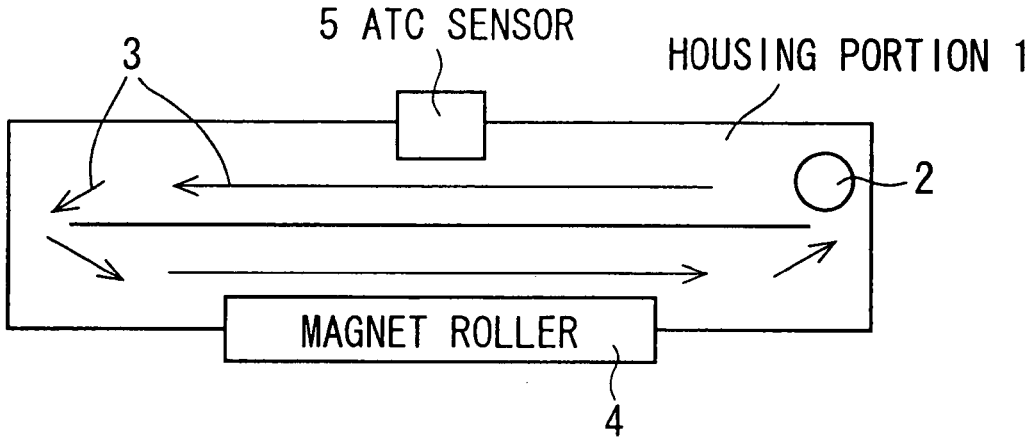
FIG. 9 PRIOR ART
FIG. 9 is a view schematically showing a housing portion for accommodating therein a dual-component developer composed of toner and carrier.
Figure 10:
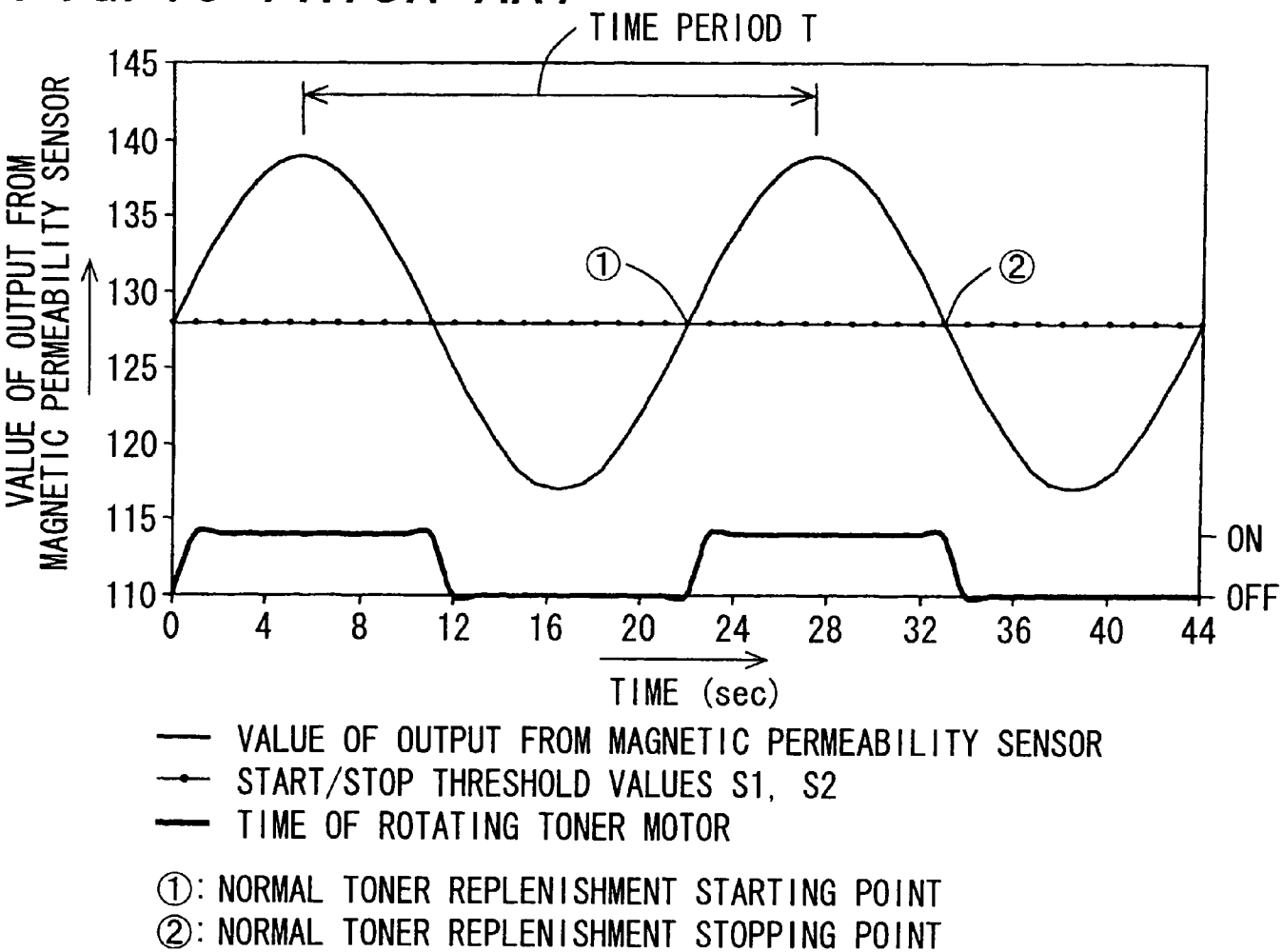
FIG. 10 PRIOR ART
FIG. 10 is a graph showing the variation of the value of output from a magnetic permeability sensor with respect to time and the change of the state of a toner motor between an ON state and an OFF state with respect to time, as observed when toner is fed into the housing portion with use of the related art.

FIG. 8 is a view showing the variation of the value of output from the magnetic permeability sensor 45 with respect to time, as observed when the replenishment of toner is effected during the replenishment extension time A. The time is taken along the horizontal axis, and the value of output from the magnetic permeability sensor 45 is taken along the vertical axis. In addition, in FIG. 8, just as in the case of FIG. 7, a temporal variation of ON/OFF of the toner motor 46 is shown. In FIG. 8, for purposes of comparison, the variation of the value of output from the magnetic permeability sensor 45 with respect to time under the condition that the replenishment extension time A is set at 0 second is indicated by a solid line, and predicted values for the concentration of toner in the vicinity of the toner introducing port 43 are indicated by alternate long and short dashed lines.

In FIG. 8, the point indicated by an arrow (1) where the value of output from the magnetic permeability sensor 45 stands at 120 is defined as a toner replenishment stopping point for effecting no extension to the replenishment of toner. Moreover, the point indicated by an arrow (2) is defined as a predicted value for the amount of toner in the vicinity of the magnet roller 23, as observed at the toner replenishment stopping point for effecting no extension to the replenishment of toner. At this point of time, the predicted output value stands at 132; that is, it is indicated that the concentration of toner is low. It will thus be seen that, if the replenishment of toner is brought to a stop under this condition, there will be a toner shortage. The point indicated by an arrow (3) is defined as a toner replenishment stopping point under the condition that the replenishment extension time A is set at 8 seconds. At the point indicated by an arrow (4), the value of output from the magnetic permeability sensor 45 stands at 0.128, and thus the replenishment of toner is resumed. At the point indicated by an arrow (5), the predicted amount of toner in the vicinity of the magnet roller 23 takes on the lowest value, and the predicted output value stands at approximately 128. In this way, instead of starting the replenishment of toner under the condition that the predicted amount of toner is lowest as indicated by the arrow (5), the replenishment of toner is resumed under the condition that there is no shortage of toner as indicated by the arrow (4). This makes it possible to solve the problem of causing a toner shortage.

In the toner replenishing apparatus 11 of this embodiment, toner concentration measurement is achieved through the measurement of magnetic permeability performed by the magnetic permeability sensor 45. However, a sensor of any given type may be used instead so long as it is capable of measuring the concentration of toner.

Moreover, in the toner replenishing apparatus 11 of this embodiment, a 1 page-coverage rate is obtained by calculation. However, the invention is not limited thereto, and it is therefore possible to calculate a coverage rate on a predetermined number of pages basis, for example, a half a page-coverage rate or a 2 page-coverage rate may be calculated instead. In a case of calculating a coverage rate on a few number of pages basis, even if there is a considerable degree of variation in the amount of toner consumption, the variation of the amount of toner consumption can be calculated with accuracy.

Further, in the toner replenishing apparatus 11 of this embodiment, toner replenishment control is exercised on the basis of image data produced by the image reading apparatus 61. However, it is also possible to exercise toner replenishment control on the basis of image data provided from a personal computer or the like which is connected to the image forming apparatus 14.

Still further, in the toner replenishing apparatus 11 of this embodiment, the control coefficient value setting section 51 determines the stop threshold value S2 and the replenishment extension time A with reference to the control coefficient value correlation table 54. However, it is also possible to obtain the stop threshold value S2 and the replenishment extension time A in a sequential manner in accordance with a predetermined relational expression based on the coverage rate, instead of making reference to the control coefficient value correlation table 54. In this case, there is no need to store the correlation among the coverage rate, the stop threshold value S2, and the replenishment extension time A. This helps reduce the storage capacity of the storage unit.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner replenishing method comprising:

a concentration measurement step of measuring a concentration of toner in a housing portion in which is accommodated a dual-component developer composed of toner and a carrier;

a consumption calculation step of determining an amount of toner consumption;

a setting step of setting, based on the amount of toner consumption determined in the consumption calculation step, a variable reference concentration for replenishment of toner to the housing portion and variable replenishment extension time for continuing the replenishment of toner to the housing portion after the concentration of toner reaches the reference concentration; and a toner concentration adjustment step of starting the replenishment of toner to the housing portion when the concentration of toner measured in the concentration measurement step is found to be equal to or less than a predetermined replenishment starting concentration, and stopping the replenishment of toner to the housing portion at a time following a lapse of the replenishment extension time from a time at which the concentration of toner of less than the reference concentration reached the reference concentration.

2. The toner replenishing method of claim 1, wherein, in the consumption calculation step, in accordance with a tone of each pixel constituting an image to be printed by an image forming apparatus, an amount of toner to be consumed for forming each of the pixels is obtained, and the operation of addition is performed on the amount of toner to be consumed thus obtained.

3. The toner replenishing method of claim 1, wherein, in the setting step, the reference concentration is so determined as to be equal to or greater than the replenishment starting concentration.

4. The toner replenishing method of claim 1, wherein, in the setting step, when the amount of toner consumption determined in the consumption calculation step is less than a predetermined value, the replenishment extension time is set at a value of 0 second, and, when the amount of toner consumption is equal to or greater than the predetermined value, the replenishment extension time is set at a value of greater than 0 second.

5. The toner replenishing method of claim 1, wherein, in the setting step, the reference concentration and the replenishment extension time are determined with reference to a correlation table showing the correlation among the amount of toner consumption, the reference concentration, and the replenishment extension time.

6. The toner replenishing method of claim 1, wherein, the housing portion is provided with an agitating/conveying member for agitating the developer accommodated in the housing portion and allowing the developer to circulate through a circulation path formed within the housing portion, and a concentration measurement section for measuring the concentration of toner in a certain part of the circulation path that is on a downstream side of the toner replenishment position in a toner conveying direction, and at a location on a downstream side of the concentration measurement section in the toner conveying direction, toner is supplied to a photoreceptor member for recording an electrostatic latent image.

7. The toner replenishment method of claim 6, wherein, in the setting step, the replenishment extension time is so determined as to fulfill the following formula (1):

$$0 \leqq A \leqq 3 \cdot T/4$$

wherein A is the replenishment extension time and T is one cycle of time-periodical variation in the concentration of toner measured by the concentration measurement section.

8. The toner replenishing method of claim 6, wherein, in the setting step, when the amount of toner consumption is equal to or greater than a predetermined value, the replenishment extension time is so determined as to fulfill the following formula (2):

$$T/4 \leqq A \leqq T/2$$

wherein A is the replenishment extension time and T is one cycle of time-periodic variation in the concentration of toner measured by the concentration measurement section.

9. The toner replenishing method of claim 6, wherein, in the setting step, when the amount of toner consumption is equal to or greater than a predetermined value, the replenishment extension time is so determined as to fulfill the following formula (3):

$$A = 3T/8$$

wherein A is the replenishment extension time and T is one cycle of time-periodic variation in the concentration of toner measured by the concentration measurement section.

10. The toner replenishing method of claim 6, wherein, in the setting step, the replenishment extension time is so determined as to fulfill the following formula (4):

$$0 \leqq A \leqq 3 \cdot U/4$$

wherein A is the replenishment extension time and U is the time taken for toner to make one round through the circulation path in the housing portion.

11. A toner replenishing apparatus comprising:

a concentration measurement section for measuring a concentration of toner in a housing portion in which is accommodated a dual-component developer composed of toner and a carrier;

a consumption calculation section of determining an amount of toner consumption;

a setting section for setting, based on the amount of toner consumption determined in the consumption calculation section, a variable reference concentration for replenishment of toner to the housing portion and variable replenishment extension time for continuing the replenishment of toner to the housing portion after the concentration of toner reaches the reference concentration; and a toner concentration adjustment section of starting the replenishment of toner to the housing portion when the concentration of toner measured in the concentration measurement section is found to be equal to or less than a predetermined replenishment starting concentration, and stopping the replenishment of toner to the housing portion at a time following a lapse of the replenishment extension time from a time at which the concentration of toner of less than the reference concentration reached the reference concentration.

12. The toner replenishing apparatus of claim 11, wherein the housing portion houses an agitating/conveying member for agitating the developer and allowing the developer to circulate through a circulation path formed within the housing portion, and the concentration measurement section is disposed in a certain part of the circulation path that is on a downstream side of the toner replenishment position in a toner conveying direction, and at a location on a downstream side of the concentration measurement section in the toner conveying direction, toner is supplied to a photoreceptor member for recording an electrostatic latent image.

13. A computer readable recording medium having a program stored thereon which allows a computer to effect:

a consumption calculation function for determining an amount of toner consumption;

a setting function for setting, based on the amount of toner consumption obtained, a variable reference concentration for a replenishment of toner to a housing portion in which is accommodated a dual-component developer composed of toner and carrier, and variable replenishment extension time for continuing the replenishment of toner to the housing portion after the concentration of toner reaches the reference concentration; and a toner concentration adjustment function for starting the replenishment of toner to the housing portion when the concentration of toner in the housing portion is found to be equal to or less than a replenishment starting concentration, and stopping the replenishment of toner to the housing portion at a time following a lapse of the replenishment extension time from a time at which the concentration of toner of less than the reference concentration reached the reference concentration.

* * * * *